US012060188B2

(12) United States Patent
Ralph

(10) Patent No.: US 12,060,188 B2
(45) Date of Patent: Aug. 13, 2024

(54) PACKAGING MACHINE AND METHOD

(71) Applicant: PROSEAL UK LIMITED, Adlington (GB)

(72) Inventor: Jack Ralph, Stockport (GB)

(73) Assignee: PROSEAL UK LIMITED, Adlington (GB)

( * ) Notice: Subject to any disclaimer, the term of this patent is extended or adjusted under 35 U.S.C. 154(b) by 171 days.

(21) Appl. No.: 17/593,235

(22) PCT Filed: Mar. 4, 2020

(86) PCT No.: PCT/GB2020/050512
§ 371 (c)(1),
(2) Date: Sep. 13, 2021

(87) PCT Pub. No.: WO2020/188238
PCT Pub. Date: Sep. 24, 2020

(65) Prior Publication Data

US 2022/0153465 A1 May 19, 2022

(30) Foreign Application Priority Data

Mar. 15, 2019 (GB) ..... 1903588

(51) Int. Cl.
*B65B 57/02* (2006.01)
*B65B 7/28* (2006.01)
(Continued)

(52) U.S. Cl.
CPC ..... *B65B 57/02* (2013.01); *B65B 7/28* (2013.01); *B65B 43/48* (2013.01); *B65B 59/003* (2019.05)

(58) Field of Classification Search
CPC ..... B65B 57/02; B65B 59/003; B65B 7/28; B65B 43/48
See application file for complete search history.

(56) References Cited

U.S. PATENT DOCUMENTS 3,987,902 A * 10/1976 Burgess ..... B65B 57/02 209/555
4,067,172 A * 1/1978 Paules ..... B65B 59/00 53/506

(Continued)

FOREIGN PATENT DOCUMENTS

EP 8309082 A1 10/2017
GB 2517145 A * 2/2015 ..... B65B 35/36

(Continued)

OTHER PUBLICATIONS

Communication Under 94(3) dated Apr. 12, 2023, issued in corresponding European Patent Application No. 20713074.1, filed Mar. 4, 2020, 4 pages.

(Continued)

*Primary Examiner* — Lucas E. A. Palmer
(74) *Attorney, Agent, or Firm* — Christensen O'Connor Johnson Kindness PLLC

(57) ABSTRACT

A packaging machine with a platform (6) on which a container (27) can be supported and sensor (23) for detecting the presence or absence of a container (27) at a position on the platform (6). A control apparatus with a memory is configured to cause the packaging machine to perform a setup operation in which relative motion between the platform (6) and sensor (23) is caused and monitored. A parameter relating to the amount of relative motion from a starting position to a position at which the sensor output changes to reflect the presence or absence of a container (27) is stored in the memory. The control apparatus is also configured to use the stored parameter to control the machine in a packaging operation.

19 Claims, 5 Drawing Sheets

(51) Int. Cl.
*B65B 43/48* (2006.01)
*B65B 59/00* (2006.01)

(56) References Cited

U.S. PATENT DOCUMENTS 4,094,413 A * 6/1978 Altenpohl ..... B65B 57/20 452/183
4,349,998 A * 9/1982 Covert ..... B65B 57/02 53/53
4,530,435 A * 7/1985 Stohlquist ..... B65B 25/006 198/374
4,691,496 A * 9/1987 Anderson ..... B67C 3/007 53/64
4,800,704 A * 1/1989 Ishii ..... B65B 25/04 53/145
5,095,684 A * 3/1992 Walker ..... B65B 57/12 53/247
5,475,965 A * 12/1995 Mondini ..... B29C 66/876 53/329.3
5,484,374 A * 1/1996 Bachner ..... B29C 66/63 493/12
5,507,085 A * 4/1996 Easton ..... B23P 19/04 29/430
5,522,439 A * 6/1996 Hakansson ..... B65B 3/30 141/237
5,588,280 A * 12/1996 Kotsiopoulos ..... B65B 61/20 53/238
5,855,106 A * 1/1999 Koyama ..... B65B 11/54 53/64
6,791,706 B1 * 9/2004 Panunto ..... B65B 61/20 358/1.18
6,854,242 B2 * 2/2005 Stork ..... B65B 53/02 53/53
9,162,825 B2 * 10/2015 Vaccari ..... B65B 31/028
9,296,505 B2 * 3/2016 Osterrieder ..... B65B 31/028
9,650,165 B2 * 5/2017 Gabler ..... B65B 43/46
2002/0055803 A1 * 5/2002 Stork ..... B65B 9/067 53/550
2002/0062628 A1 * 5/2002 Whitby ..... B65B 57/14 53/493
2004/0083690 A1 * 5/2004 Gambetti ..... B65B 11/10 53/210
2004/0221549 A1 * 11/2004 Guttinger ..... B65G 47/57 53/540
2005/0262802 A1 * 12/2005 Natterer ..... B65G 47/082 198/418
2009/0301658 A1 * 12/2009 Vine ..... B65B 43/46 198/813
2011/0072764 A1 * 3/2011 Daniek ..... B26D 7/2614 53/556
2012/0323830 A1 * 12/2012 Ickert ..... G06N 3/10 706/12
2013/0227914 A1 * 9/2013 Allgaier ..... B65B 57/04 53/285
2013/0255852 A1 * 10/2013 Payne ..... B65B 57/04 156/359
2014/0338287 A1 * 11/2014 Pelagatti ..... B65B 57/20 198/348
2016/0332823 A1 * 11/2016 Yang ..... B65H 31/08
2018/0118395 A1 * 5/2018 Guzman ..... B65B 25/065
2021/0039348 A1 * 2/2021 Fujita ..... G05B 13/048
2021/0101764 A1 * 4/2021 Olshenske ..... B25J 5/007

FOREIGN PATENT DOCUMENTS

GB 2517145 A 2/2015
GB 2570155 A 7/2019
WO 2009/022180 A2 2/2009

OTHER PUBLICATIONS

Examination Report completed May 10, 2021, issued in corresponding Application No. GB 1902588.00, filed Mar. 15, 2019, 4 pages.
International Search Report and Written Opinion dated May 8, 2020, issued in corresponding Application No. PCT/GB2020/050512, filed Mar. 4, 2020, 11 pages.
Search Report completed Aug. 2, 2019, issued in corresponding Application No. GB 1902588.00, filed Mar. 15, 2019, 1 page.

* cited by examiner

PACKAGING MACHINE AND METHOD

TECHNICAL FIELD OF THE INVENTION

The present invention relates to a packaging machine and to a method of setting up a packaging machine.

BACKGROUND TO THE INVENTION

Packaging machinery is used in many packaging processes, including fabrication, cleaning, sealing and labelling. A packaging production line typically comprises a plurality of conveyors which advance packages along the line. One or more packaging machines may be provided along the line to perform a required function. For example, where the production line relates to the packaging of product, such as a foodstuff, in trays, the production line may comprise a tray sealer.

Tray sealers are well known. A typical tray sealer comprises an infeed conveyor which advances containers containing product towards a sealing station. An accumulation conveyor receives the containers from the infeed conveyor and operates to space the containers in a predetermined manner. Opposed transfer arms each having spaced apart fingers defining bays close around multiple containers, so that one container is received into each bay, and transfer them from the accumulation conveyor into the sealing station so that they are positioned correctly relative to sealing tools in the sealing station. The arms then move apart allowing the sealing tools to close and seal the trays with film. Following sealing the transfer arms close around the, now sealed, containers and move them out of the sealing station onto an outfeed conveyor which transports the containers away from the tray sealer.

Control apparatus including one or more sensors that detect the position of containers on the infeed and/or accumulation conveyors controls the operation of the infeed and accumulation conveyors to position the containers on the accumulation conveyor so that the containers may be engaged by the transfer arms. In particular, the containers need to be positioned and spaced apart relative to one another on the accumulation conveyor so that they are received into the respective bays defined by the transfer arms without being crushed or knocked over. Tray sealers may be reconfigured to handle different sizes of container by changing the transfer arms and tooling in the sealing station. When the machine is reconfigured the control system must be re-programmed so that containers are correctly positioned on the accumulation conveyor to be received into the bays defined by the transfer arms.

In an existing tray sealer, the way in which the control system causes the infeed and accumulation conveyors to operate is defined by three positioning parameters, pitch, position and length, and the number of containers. Pitch relates to the desired distance between containers on the accumulation conveyor. Position relates to the distance between the rear edge of the last container moved onto the accumulation conveyor and a position sensor, typically located near or just before the beginning of the accumulation conveyor, when the required number of containers have been transferred onto the accumulation conveyor. Length relates to the length of individual containers, measured along the direction of travel of the accumulation conveyor. The number of trays is the number of bays defined by the transfer arms.

Whilst for given containers and transfer arms the position parameters can be calculated theoretically. In practice, given the performance of individual machines, operation. So, typically, a machine operator will estimate the positioning parameters and input them into the machine. The operator will then initiate a test run, causing containers to be lined up on the accumulation conveyor ready for pick up by the transfer arms. As the final container is positioned ready for the transfer arms to close the operator interrupts the machine cycle to observe if the containers are correctly positioned relative to the transfer arms. If not the parameters are altered before running a further test. The machine cycle is typically interrupted by a guard being opened, emergency stop being pressed or a downstream error being enabled. The process is repeated as necessary until the machine runs reliably.

This trial and error process is time consuming, resulting in valuable machine time being lost when a machine is reconfigured to handle a different type of container. Although it leads to satisfactory operating parameters being determined, they may not actually be optimum. Steps taken to stop the machine during trial and error testing may expose the operator to risk and/or risk of damaging or contaminating the machine.

It is an object of embodiments of the present invention to provide an improved packaging machine and/or to address one or more of the problems discussed above.

SUMMARY OF THE INVENTION

According to a first aspect of the present invention there is provided a packaging machine comprising: a platform on which a container can be supported; longitudinal transfers arms shaped to define engagement locations to engage containers on the platform in spaced apart locations along the lengths of the transfer arms; a sensor for detecting the presence or absence of a container at a position on the platform; and a control apparatus with a memory, wherein the control apparatus is configured to cause the packaging machine to perform a setup operation in which relative motion between the platform and sensor is caused and monitored and a parameter relating to the amount of relative motion from a starting position to a position at which the sensor output changes to reflect the presence or absence of a container is stored in the memory, and the control apparatus is configured to use the stored parameter to control the machine in a packaging operation.

According to a second aspect of the present invention there is provided a method of setting up a packaging machine according to the first aspect of the invention comprising the steps of:

- initiating the setup operation;
- placing one or more containers in a pre-determined position or positions on the platform corresponding to the engagement locations of the longitudinal transfer arms;
- causing the setup up operation to continue.

According to a third aspect of the present invention there is provided a method of setting up a packaging machine having longitudinal transfers arms shaped to define engagement locations to engage containers in spaced apart locations along the lengths of the transfer arms, comprising the steps of:

- placing on or more containers in a pre-determined position or positions on a platform of the machine corresponding to the engagement location(s) of the longitudinal transfer arms;
- causing and monitoring relative movement between the platform and a sensor of the machine, the sensor arranged to detect the presence or absence of a container at a position on the platform;

storing a parameter in a memory of the machine, the parameter relating to the amount of relative motion from a starting position to a position at which the sensor output changes to reflect the presence or absence of a container, for subsequent use in controlling the machine in a packaging operation.

According to a fourth aspect of the present invention there is provided a method of setting up a packaging machine having longitudinal transfers arms shaped to define engagement locations to engage containers in spaced apart locations along the lengths of the transfer arms, comprising the steps of: placing a first container at an end position on the a platform of the machine corresponding an engagement location of the longitudinal transfer arms; placing a second container at a position not adjacent the end position of the first container corresponding another engagement location of the longitudinal transfer arms; detecting the presence of the first and second containers at their respective positions of the platform using the sensor; and storing a parameter in a memory of the machine of the number of container positions on the platform, for subsequent use in controlling the machine in a packaging operation.

In all aspects, by placing a container on the platform in a desired position and causing the machine to perform the setup operation, the machine is able to determine and store an operational parameter for use in a packaging process. As the parameter is measured by the machine it is inherently specific to the machine and to the type of container used in the setup operation, with the result that it leads to reliable operation of the machine in a packaging operation for the type of container used in the setup operation.

The control apparatus may be arranged to determine and store more than one control parameter.

The control apparatus may be arranged to store a parameter relating to the amount of relative motion from a starting position to the point at which a container is detected by the sensor. A parameter determined and stored in this way may be used as, or to derive, a position, positioning parameter which relates to the distance of the edge of a container from the sensor.

The control apparatus may be arranged to store a parameter relating to the amount of relative motion from a position at which the sensor first detects the presence of a container to a position at which the sensor no longer detects the presence of the container. A parameter determined and stored in this way may be used as, or to derive, a length, positioning parameter which relates to the length of a container in the direction of relative motion between the sensor and platform.

The control apparatus may be arranged to store a parameter relating to the amount of relative motion from a position at which the sensor first detects the absence of one container to a position at which the sensor first detects the presence of another container. A parameter determined and stored in this way may be used as, or to derive, a pitch, positioning parameter which relates to the distance between adjacent containers on the platform in the direction of relative motion between the sensor and platform.

The control apparatus may be arranged to store a parameter relating to the number of containers sequentially detected by the sensor. Thus, the packaging machine can automatically determine the number of containers positioned on the platform.

Determining all three position parameters and the number of containers provides sufficient information for the packaging machine to perform a packaging operation. A user does not need to input any operational parameters.

The packaging machine may comprise a transfer arrangement operable to move to a pick-up position to engage a one or more containers at a predetermined position or positions on the platform during a packaging operation. In this case the control apparatus may be arranged, during the setup operation, to cause the transfer arrangement to move to the pick-up position to enable a user to place a container or containers on the platform at the/or each predetermined position. This is advantageous as, during the setup operation, the transfer arrangement can be used as a guide to accurately position a container or containers the position, size and spacing of which may be determined by the machine during the setup operation. The parameters thus determined enable the machine to correctly place containers in the pick-up position(s) at which they can be correctly engaged by the transfer arrangement during a packaging operation.

The transfer arrangement may comprise a pair of transfer arms. Each transfer arm may define one or more bays. The transfer arms may be positioned at opposite sides respectively of the platform. The transfer arms may be arranged, together, to engage one or more containers on the platform. The transfer arms may be moveable away from each other to an open state, in which they cannot engage containers on the platform, and towards each other to a closed state in which they can engage containers on the platform. In the pickup position the arms may be in the closed state.

During the setup operation, after the control apparatus has moved the transfer arrangement to the pick-up position it preferably pauses the machine until a user provides an input. The control means may cause a user interface to prompt a user to introduce one or more containers into the transfer arrangement on the platform and then to operate a control to confirm when the containers have been introduced. The control means may then cause the transfer means to move away from the container(s), leaving the containers at desired positions on the platform and permitting the container(s) to move with the platform. The transfer arms may be moved away from the containers more slowly than they move during a packaging operation to reduce the risk of moving the containers from the desired positions, as this would affect parameters measured by the packaging apparatus during the setup operation.

The platform may comprise a conveyor. The sensor may be arranged to detect the presence or absence of a container at a fixed position relative to the conveyor. The conveyor may extend, and transport containers, in a longitudinal direction of the machine. The conveyor may comprise one or more conveyor belts or other endless conveyors, or may comprise rollers or take any other suitable form. The conveyor may move more slowly during the setup operation than during a packaging operation. Slow movement of the conveyor is advantageous as it minimises the likelihood of disturbing the position of containers positioned thereon, and thus altering parameters measured during the setup operation.

The sensor may comprise an emitter which emits a beam and a receiver, such as a photoelectric sensor, which receives the beam. Where the platform comprises a conveyor, the beam may extend perpendicular to the direction of travel of the conveyor. The sensor output may thus change between a state where the receiver receives the beam, indicating that no container is present at the beam position, and a state where the receiver does not receive the beam indicating that a container is present at the beam position. A narrow beam allows the position at which the sensor output state changes to be well-defined.

The control apparatus may be arranged to monitor the distance moved by the conveyor relative to the sensor. The distance may be monitored by an encoder, which may be comprised in a servo motor or other actuator which drives the platform.

The control apparatus may cause the conveyor to move in one direction during the setup operation, and the opposite direction during a packaging operation. The one direction may be away from a sealing station of the machine, and the opposite direction may be towards the sealing station. In this way the sensor employed during the setup operation may also be used during a packaging operation to control positioning of containers on the platform. The sensor may be positioned towards an end of the platform away from the machine. In one embodiment the platform comprises accumulation and infeed conveyors and the sensor is positioned at the end of the infeed conveyor adjacent the accumulation conveyor.

Alternatively, the control apparatus may cause the platform to move in the same direction during both setup and packaging operations. In this case the sensor needs to be placed in front of the pick up positions for containers on the platform in the direction of travel of the platform. A second sensor is therefore required for positioning of containers on the platform during a packaging operation. Where the length of containers varies with their height the two sensors must be positioned at the same height over the platform. Single sensor embodiments avoid this complication.

Where the conveyor comprises an accumulation conveyor the control apparatus may be arranged, during a packaging operation, to control motion of the accumulation conveyor to position containers on the conveyor at predetermined positions relative to one another and to the packaging machine. Advantageously, the control apparatus can use the or each stored parameter to control the accumulation conveyor to position the containers in the predetermined positions, which will ideally be suitable for the transfer arrangement to engage the containers.

The control apparatus may comprise a processor and/or an interface. The interface may allow a user to provide the packaging machine with instructions and/or information.

The packaging machine may be a tray sealer. The containers may be trays.

DETAILED DESCRIPTION OF THE INVENTION

In order that the invention may be more clearly understood one or more embodiments thereof will now be described, by way of example only, with reference to the accompanying drawings, of which:

Figure 1:
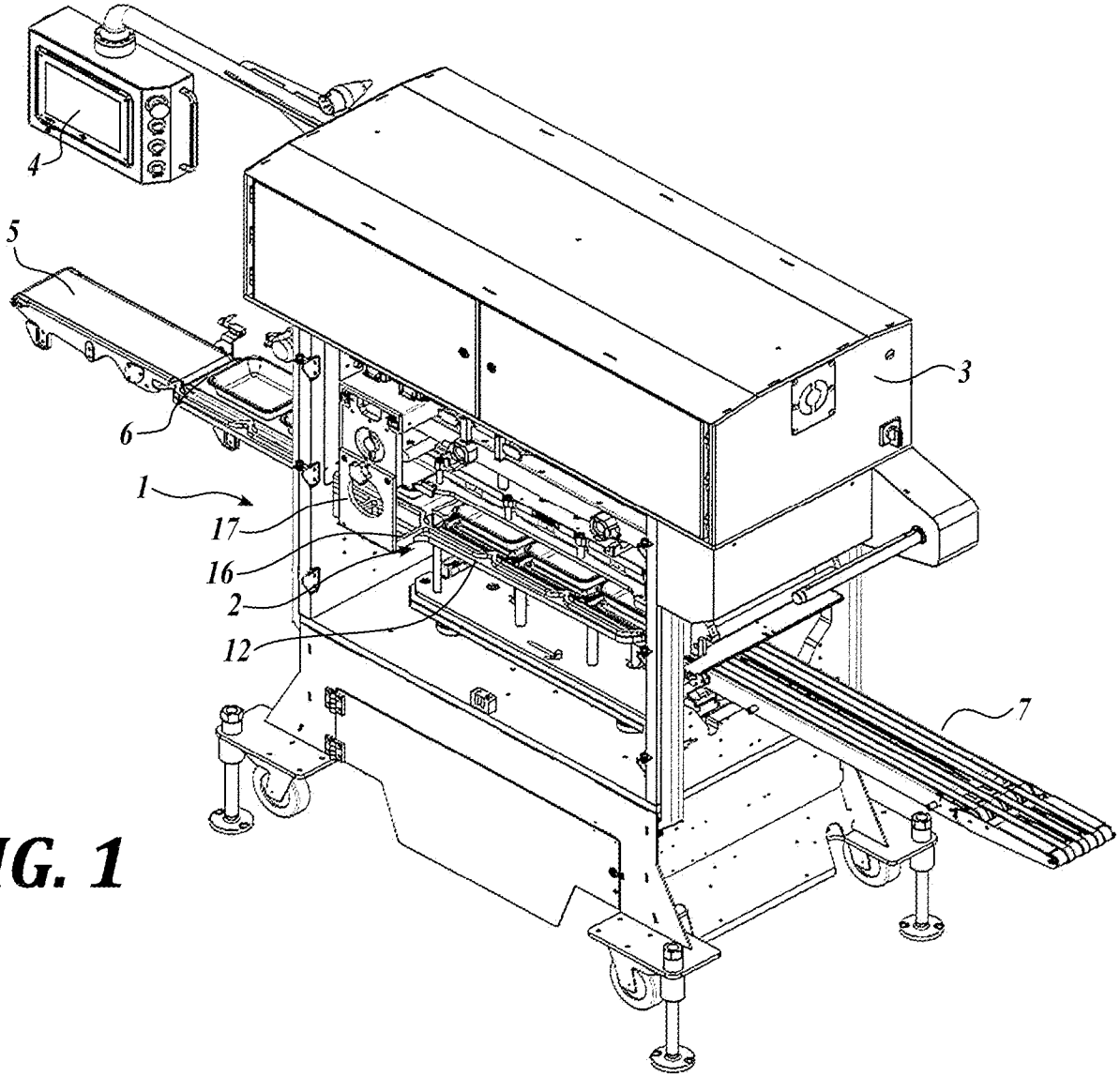
FIG. 1 is a perspective view of a packaging machine.
Figure 2:
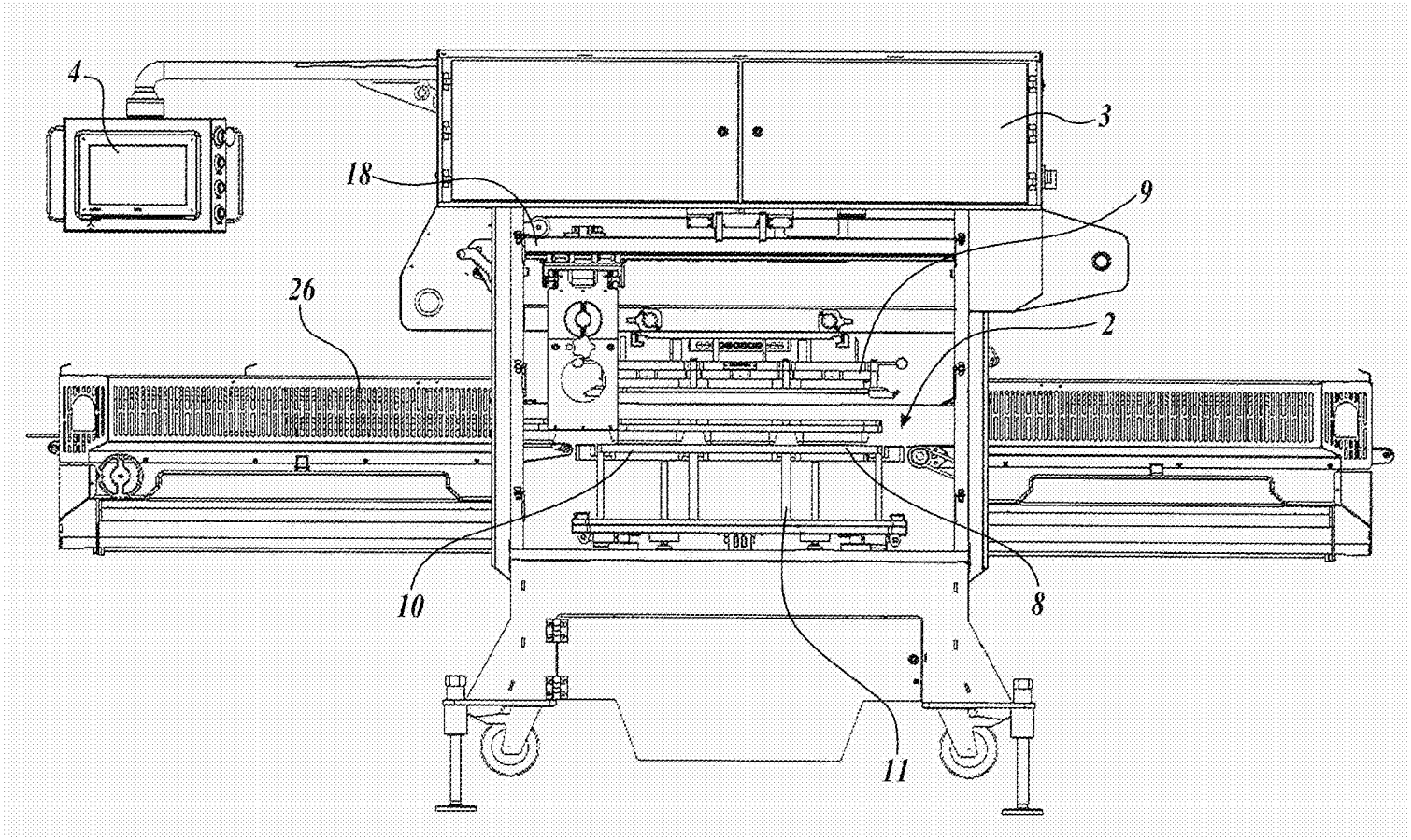
FIG. 2 is a front view of the packaging machine of FIG. 1.

In what follows the terms upper, lower, top, bottom, left and right are used to refer to the packaging machine and its components in the orientation in which it is illustrated, which is the orientation in which it is intended to be used, but should not be taken as otherwise limiting. Like reference numerals are used to denote like features throughout the drawings, which are not to scale.

Referring to the drawings, there is shown a packaging machine. The packaging machine is a tray sealer comprising a main body in the form of a cabinet 1 which houses a sealing station 2 over which is a second cabinet 3 housing switchgear and programmable control apparatus. The programmable control apparatus comprises a processor connected with a memory (or other suitable storage means) and is appropriately programmed to cause the machine to perform the functions described herein. A machine operator may operate the machine via an interface 4, such as a touch screen, provided as part of the control apparatus.

The machine is for sealing trays and comprises three servomotor driven conveyors 5, 6, 7. A first, infeed, conveyor 5 is supported on the outside left side of the cabinet 1 and extends toward a second, accumulation, conveyor 6. The accumulation conveyor 6 is also supported on the outside left side of the cabinet 1 and extends parallel to the infeed conveyor 5 from a position adjacent the end of the infeed conveyor 5 to protrude slightly into an opening in the left-hand side of the cabinet 1.

A third, outfeed, conveyor 7 extends from slightly inside an opening in the right-hand side of the cabinet 1, out of said opening and away from the cabinet 1.

The outfeed conveyor 7 extends parallel to the infeed and accumulation conveyors 5, 6. The central elongate axis of each of the three conveyors are aligned. All conveyors are substantially level and at the same height.

In operation, trays are carried toward the sealing station 2 by the infeed and accumulation conveyors 5, 6 and are carried away from the sealing station 2 by the outfeed conveyor 7.

The sealing station 2 is of a largely conventional type and is therefore not described in detail. Briefly, the sealing station 2 comprises a lower tool 8 and an upper tool 9. The lower 8 and upper tool 9 are removably fitted to the machine and are adapted to cooperate with trays to be sealed.

The lower tool 8 is supported on a platform 10 which is mounted to an actuator 11 operable to raise and lower the platform 10 and thus the lower tool 8 relative to the rest of the machine. In a lowered position, the lower tool 8 is of recesses for receiving trays to be sealed. In this exemplary embodiment, the lower tool is substantially rectangular with curved corners and comprises three, evenly spaced, substantially rectangular, recesses formed in its upper surface. The central elongate axis of the lower tool 8 is aligned with that of each of the three conveyors 5, 6, 7.

The upper tool 9 is positioned above the lower tool 8 in a fixed position. The upper tool 9 is heated and in use a sealing film (not shown) extends between the two tools adjacent the upper tool 9.

The machine comprises a pair of transfer arms 12 positioned above and at opposite sides respectively of the lower tool 8 (when in a lowered position). Each arm is elongate with a rectangular cross section. The arms 12 are level and extend parallel to the long sides of the lower tool 8 (and consequently, parallel to the three conveyors 5, 6, 7) and substantially parallel to the upper surface of the lower tool. The transfer arms 12 are mirror opposites of each other.

The opposed, inner faces of the arms are shaped to engage with multiple spaced apart trays. Each arm comprises six fingers 13 provided in two groups of three separated by a central portion 14 which projects in the same direction as the fingers 13. The three fingers in each group are evenly spaced and the width of the central portion is approximately equal to the separation between adjacent fingers. The fingers 13 and central portions 14 of each arm together define six bays 15. The lower edge of each bay comprises a lip projecting diagonally outward so that when the arms close around a tray, the tray is lifted slightly from the surface on which it is supported.

A central connecting bracket 16 projects from the outer face of the arm opposite the central portion 14. A first substantially vertical support member 17 connects at one end to the bracket 16 of one arm and is movably mounted at the other end to one of a pair of parallel rails 18. A second substantially vertical support member 19 connects to the bracket 20 of the other arm and is movably mounted to the other rail. The rails 18 are vertically positioned above the upper tool 9 and extend horizontally and parallel to the long sides of the lower tool 8.

The rails 18 are movably mounted on transverse, horizontal supports and a servomotor controls the separation between the rails 18. The arms are movable away from each other to an open state in which the minimum separation between the arms is greater than the tray width so that a tray may travel along the conveyors 5, 6, 7 between the transfer arms 12, and also movable towards each other to a closed state in which a tray positioned between the transfer arms 12 is engaged by the arms.

Each support member 17, 19 is driven along the rails 18 by a servomotor provided at its rail-mounted end. The arms 12 are movable from a pick-up position, wherein the three bays defined at the infeed end of the arms (infeed bays) 21 are positioned above the accumulation conveyor 6 and the three bays at the opposite ends of the arms (outfeed bays) 22 are positioned above, and aligned with, the recesses in the lower tool 8, to a set-down position, wherein the infeed bays 21 are positioned above, and aligned with, the recesses in the lower tool 8 and the outfeed bays 22 are positioned above the outfeed conveyor 7.

The control apparatus controls the operation of all servomotors in the packaging machine. Each servomotor comprises an encoder, which outputs a pulsed signal to the control apparatus representative of the motion of the servomotor. The control apparatus monitors the motion of the servomotor by counting pulses output by the encoder, and uses this information to determine the position, speed and like information relating to the motion of each servomotor. For the servomotors used to drive the conveyors 5, 6, 7, the control apparatus uses the encoder information to determine the distance travelled by the conveyor.

A photoelectric, break-beam sensor 23 is provided at the end of the infeed conveyor 5 closest the accumulation conveyor 6. The sensor 23 comprises an emitter which emits a beam 25 (typically of visible or infra-red light) and a receiver (not shown) which detects the beam 25. The beam 25 extends perpendicularly across the conveyor path. The break-beam sensor 23 is connected to the control apparatus and is arranged to output a first signal thereto when the beam 25 is detected by the receiver (indicating the absence of a tray in the line-of-sight of the sensor 23) and a second signal when the beam 25 is "broken", and is therefore not detected by the receiver (indicating the presence of a tray in the line-of-sight of the sensor 23). The first signal may be an output from the sensor and the second signal the absence of an output. The control apparatus is configured to count the number of trays which pass the sensor 23.

Figure 3:
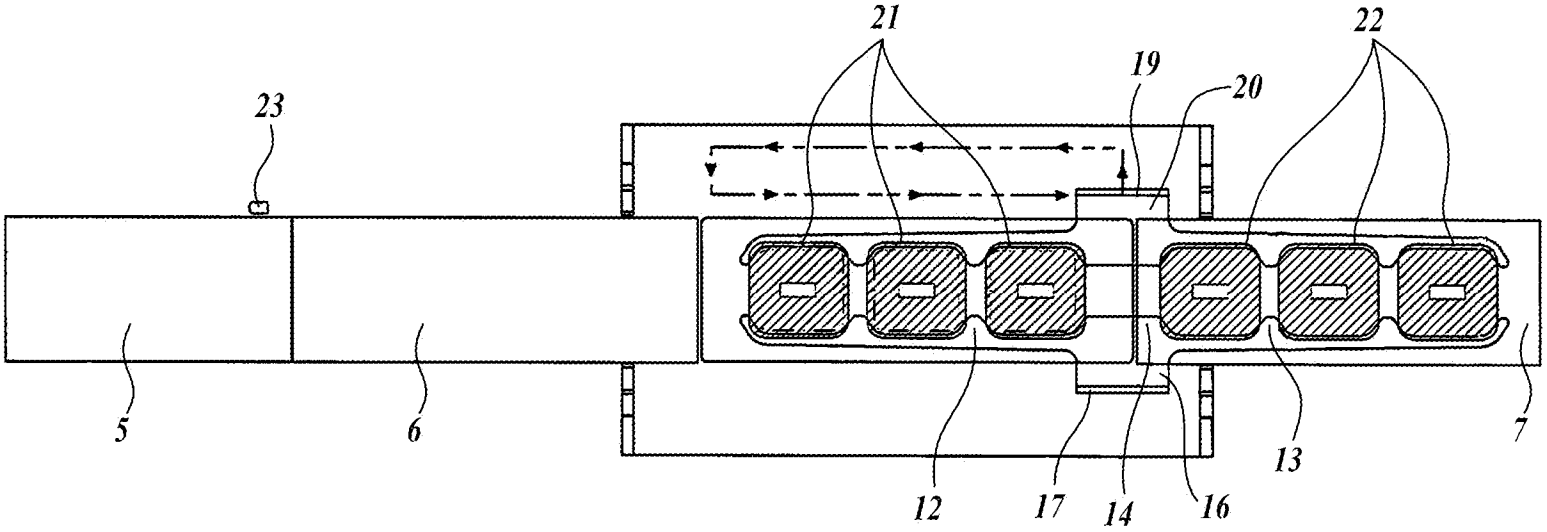
FIG. 3 is a schematic plan view of part of the machine of FIG. 1 in a first state.
Figure 4:
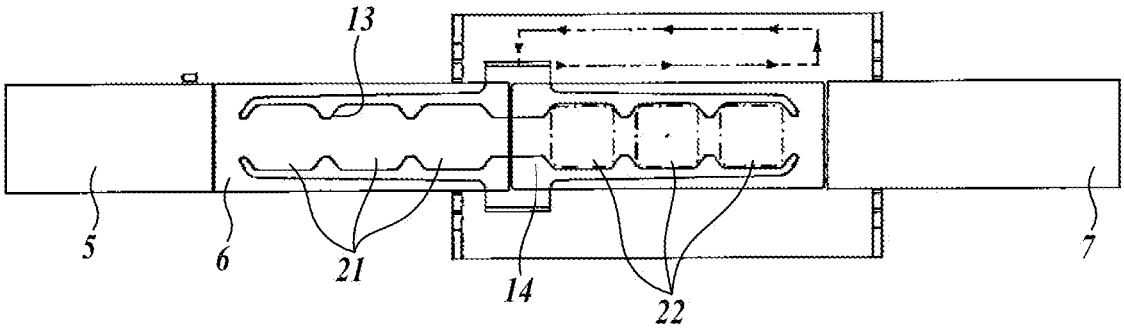
FIGS. 4 to 9 are corresponding views to FIG. 3 showing the machine in different sequential states during a setup operation.
Figure 5:
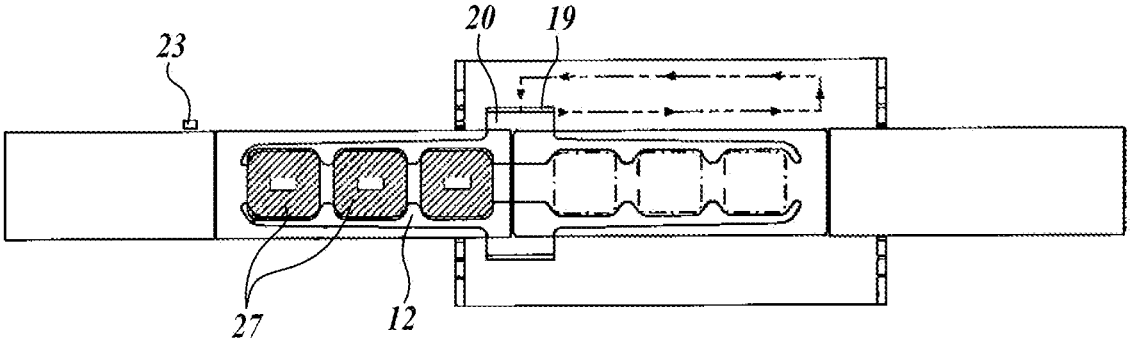
Figure 6:
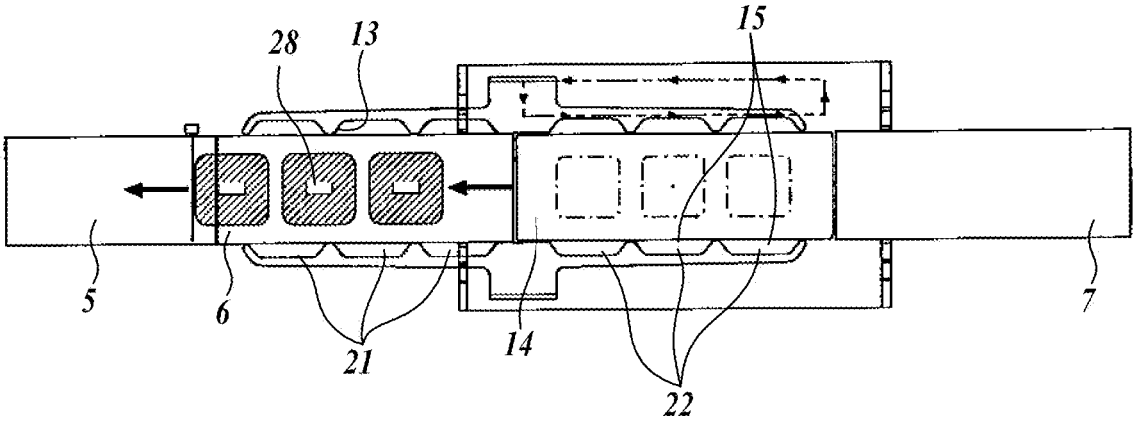

As with conventional tray sealers, the control apparatus causes the infeed and accumulation conveyors 5, 6 to operate depending on three positioning parameters, pitch, position and length, and the number of containers.

Where the control apparatus differs from prior apparatus is that it is arranged to cause the machine to perform a setup operation to determine the positioning parameters and number of trays using information provided by the accumulation conveyor servomotor encoder and the photoelectric sensor 23. Setup of the machine takes place as follows:

a) A machine operator initiates the setup operation from the interface 4. If the setup operation is part of the initialisation of the machine, it is envisioned that the machine will be free from trays. However, if the setup operation is part of a recalibration of the machine, it is important to ensure that there are no trays on the infeed and accumulation conveyors 5, 6. So, initiating the setup operation may involve a final operation of the machine to transfer any trays the machine to the outfeed conveyor 7, resulting in the transfer arms 12 being in the set down position as shown in FIG. 3.

b) After any operation to clear trays from the machine, the transfer arms 12 are moved to the pick-up position and closed state, as shown in FIG. 4. The machine then prompts the user to place trays into the infeed bays 21 of the transfer arms 12. The machine operator opens the protective guard 26 covering the accumulation conveyor 6 and places a tray into each infeed bay, as shown in FIG. 5. The sample trays 27 are the same size and shape as the trays to be sealed, and although they do not contain any foodstuff, a weight 28 may be placed in each sample tray so that they behave like a tray containing foodstuff.

c) The machine operator then informs the control apparatus, via the interface 4, that the sample trays 27 have been placed into the any movement along the rails 18, the transfer arms 12 are moved slowly into the open state (that is, slower that the transfer arms are opened during a packaging operation) to leave the sample trays 27 in the pick-up position on the accumulation conveyor 6, as shown in FIG. 6.

Figure 7:
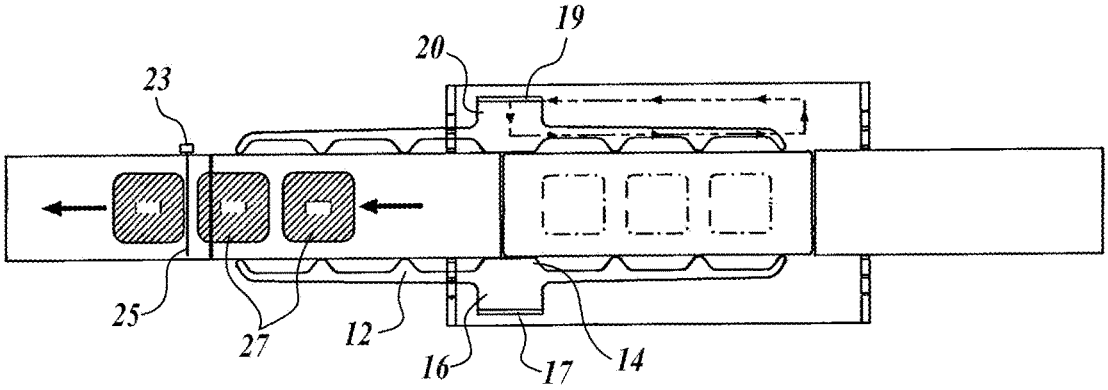
Figure 8:
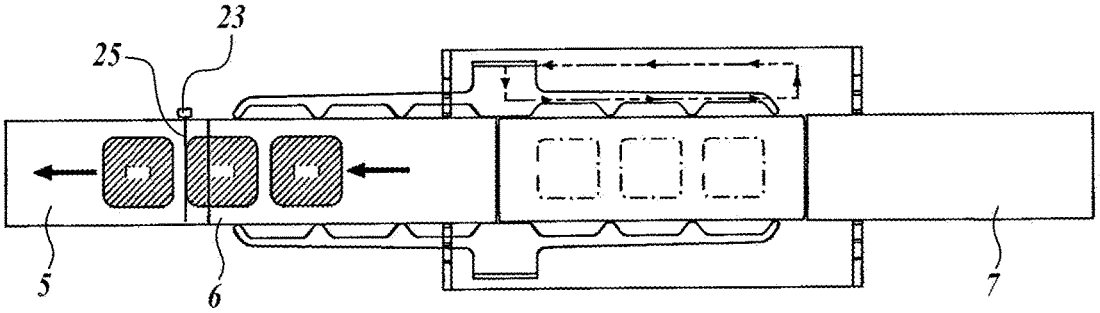
Figure 9:
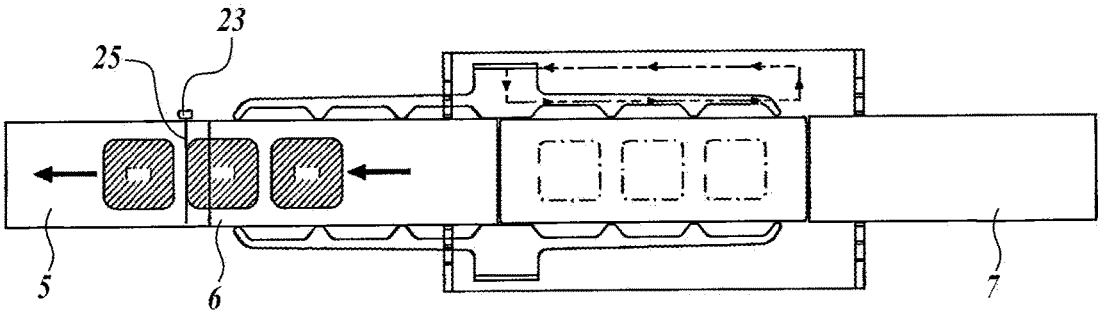

The machine then automatically determines the positioning parameters, and the number of trays, as follows:

a) The infeed and accumulation conveyors 5, 6 are operated in reverse at substantially the same speed as each other to carry the trays 27 away from the sealing station. During this step, the conveyors are operated to run slowly (that is, slower that the conveyors operate during a packaging operation) to ensure that the trays do not move from their positions. The infeed and accumulation encoders provide information to the control apparatus representative of the rotation of each servomotor and thus movement of the conveyors 5, 6.

b) The control apparatus records movement of the accumulation conveyor 6 and, when the rearmost tray (that is, the tray farthest the sealing station) breaks the beam 25 of the photoelectric sensor 23, as shown in FIG. 7, the control apparatus stores the distance moved by the accumulation conveyor from the start of the movement in memory as the position positioning parameter. The control apparatus also records that one tray has passed the sensor.

c) When the beam 25 is received again by the receiver 24 following 23, as shown in FIG. 8, the control apparatus stores the distance moved by the conveyor 6 since the beam was broken as the length positioning parameter.

d) When the second rearmost tray breaks the beam 25 of the photoelectric sensor 23, as shown in FIG. 9, the control apparatus stores the distance moved since the beam 25 was restored as the pitch positioning parameter. The control apparatus also records that two trays have passed the sensor 23.

e) The control apparatus continues to drive the conveyor 6 until it has moved a distance approximately equal to the length of the conveyor and increases the conveyor count for each further container detected thereby to count the total number of trays and stores this value.

The three positioning parameters are thereby determined with high accuracy and are stored in memory. The number of trays is also determined, which indicates the number of infeed bays 21. The positioning parameters and number of trays parameter can then be used in normal operation of the packaging machine to position trays correctly on the accumulation conveyor 6 so that moving the transfer arms 12 to the pick-up position and closing the arms allows the trays to be received into the bays.

Optionally, the machine may be configured so that one sample tray need not be placed into each infeed bay 21. In this configuration, the machine may prompt the machine operator to inform the control apparatus, via the interface 4, of the number of transfer arm bays 21 and also in which bays sample trays 27 are placed.

Where a first sample tray is placed in the rearmost infeed bay, and a second sample tray is placed in a second, non-consecutive, infeed bay, the position and length parameters may be determined as described above, and the pitch positioning parameter may be calculated using knowledge of the bay in which the second sample tray is placed. Where the first sample tray is not placed in the rearmost infeed bay, the position parameter may still be determined using knowledge of the bay in which the first sample tray is placed.

Further optionally, the machine may be configured so that only one item of the information is required to be inputted by the machine operator. In this regard, a first sample tray is placed in the rear most infeed bay and a second sample tray is placed in the next adjacent infeed bay. With this arrangement, the only information that the operator need input is the number of infeed bays. The system can determine the pitch using the first and second sample trays and with the knowledge of the number of sample bays the position and length parameters may also be determined. It will be appreciated that a minimal amount of information need be provided to the control apparatus while resulting in precise and accurate configuring of the packaging machinery.

The one or more embodiments are described above by way of example only. Many variations are possible without departing from the scope of protection afforded by the appended claims.

The invention claimed is:

1. A packaging machine comprising:

a platform on which a container can be supported;

longitudinal transfers arms shaped to define a plurality of engagement locations to engage containers in the engagement locations along the lengths of the transfer arms, wherein the transfer arms are operable to move to a pick up position to engage a container at a predetermined position on the platform during a packaging operation;

a sensor for detecting the presence or absence of a container at a position on the platform; and a control apparatus with a memory, wherein the control apparatus is configured to cause the packaging machine to perform a setup operation in which relative motion between the platform and the sensor is caused, and monitored, whereby the control apparatus causes the transfer arms to move to the pick-up position to enable a user to place containers in at least one but not all of the engagement positions of the transfer arms, and a first parameter relating to the number of engagement locations existing along the transfer arms, a second parameter relating to which of the engagement locations contain a container, and a third parameter relating to the amount of relative motion from a starting position to a position at which the sensor output changes to reflect the presence or absence of a container are stored in the memory, and the control apparatus is configured to use the stored parameters to control the machine in a packaging operation.

2. A packaging machine as claimed in claim 1, wherein during the set-up operation the control apparatus is arranged to store a parameter relating to the amount of relative motion from a starting position to the point at which a container is detected by the sensor.

3. A packaging machine as claimed in claim 1, wherein during the setup operation the control apparatus is arranged to store a parameter relating to the amount of relative motion from a position at which the sensor first detects the presence of a container to a position at which the sensor no longer detects the presence of the container.

4. A packaging machine as claimed in claim 1, wherein during the set-up operation the control apparatus is arranged to store a parameter relating to the amount of relative motion from a position at which the sensor first detects the absence of one container to a position at which the sensor first detects the presence of another container.

5. A packaging machine as claimed in claim 1, wherein during the setup operation the control apparatus is arranged to store a parameter relating to the number of containers sequentially detected by the sensor.

6. A packaging machine as claimed in claim 1, wherein the transfer arms each defining one or more bays and arranged, together, to engage with one or more containers on the platform.

7. A packaging machine as claimed in claim 1, wherein the platform comprises a conveyor and the sensor is arranged to detect the presence or absence of a container at a fixed position relative to the conveyor.

8. A packaging machine as claimed in claim 7, wherein, during the setup operation, the control apparatus is arranged to monitor the distance moved by the conveyor relative to the sensor.

9. A packaging machine as claimed in claim 7, wherein during the setup operation the control apparatus is arranged to cause the conveyor to move in one direction, and during a packaging operation it causes the conveyor to move in the opposite direction.

10. A packaging machine as claimed in claim 7, wherein the conveyor is an accumulation conveyor and the control apparatus is arranged, during a packaging operation, to control motion of the conveyor to position containers on the conveyor at predetermined positions relative to one another and to the packaging machine.

11. A packaging machine as claimed in claim 7, comprising an encoder for monitoring motion of the conveyor.

12. A packaging machine as claimed in claim 1 wherein the packaging machine is a tray sealer.

13. A method of setting up a packaging machine having longitudinal transfers arms shaped to define engagement locations to engage containers in spaced apart locations along the lengths of the transfer arms, comprising the steps of:

a. placing one or more containers in a predetermined position or positions on a platform of the machine corresponding to the engagement location(s) of the longitudinal transfer arms, and with at least one of the engagement locations void of a container;

b. causing and monitoring relative movement between the platform and a sensor of the machine;

c. detecting the presence or absence of a container at a position on the platform using the sensor; and d. storing, in a memory of the machine, a first parameter relating to the number of engagement locations existing along the transfer arms, a second parameter relating to which of the engagement locations contain a container, and a third parameter relating to the amount of relative motion from a starting position to a position at which the sensor output changes to reflect the presence or absence of a container, for subsequent use in controlling the machine in a packaging operation.

14. A method as claimed in claim 13, wherein the third parameter relates to the amount of relative motion from a starting position to the point at which a container is detected by the sensor.

15. A method as claimed in claim 13, wherein the third parameter relates to the amount of relative motion from a position at which the sensor first detects the presence of a container to a position at which the sensor no longer detects the presence of the container.

16. A method as claimed in claim 13 wherein the third parameter relates to the amount of relative motion from a position at which the sensor first detects the absence of one container to a position at which the sensor first detects the presence of another container.

17. A method as claimed in claim 13, wherein the third parameter relates to the number of containers sequentially detected by the sensor.

18. A method as claimed in claim 13, wherein the platform comprises a conveyor which moves relative to the sensor which remains fixed relative to the remainder of the machine.

19. A packaging machine comprising:

a platform on which a container can be supported;

longitudinal transfer arms shaped to define a plurality of engagement locations to engage containers in the engagement locations along the lengths of the transfer arms, wherein the transfer arms are operable to move to a pickup position to engage a container at a predetermined position on the platform during a packaging operation;

a sensor for detecting the presence or absence of a container at a position on the platform; and a control apparatus with a memory, wherein the control apparatus is configured to cause the packaging machine to perform a setup operation in which relative motion between the platform and the sensor is caused, and monitored, whereby the control apparatus causes the transfer arms to move to the pick-up position to enable a user to place containers in the two engagement positions of the transfer arms closest to the sensor, and a first parameter relating to the number of engagement positions exist along the transfer arms and a second parameter relating to the amount of relative motion from a starting position to a position at which the sensor output changes to reflect the presence or absence of a first container is stored in the memory, and the control apparatus is configured to use the stored parameters to control the machine in a packaging operation.

* * * * *